US011189440B2

(12) United States Patent
Hsu et al.

(10) Patent No.: US 11,189,440 B2
(45) Date of Patent: Nov. 30, 2021

(54) ELECTRONIC DEVICE

(71) Applicant: PEGATRON CORPORATION, Taipei (TW)

(72) Inventors: Wei-Chih Hsu, Taipei (TW); Pen-Uei Lu, Taipei (TW); Mao-Hsiang Huang, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 0 days.

(21) Appl. No.: 16/910,384

(22) Filed: Jun. 24, 2020

(65) Prior Publication Data

US 2021/0166894 A1 Jun. 3, 2021

(30) Foreign Application Priority Data

Nov. 29, 2019 (TW) ..... 108143831

(51) Int. Cl.
*H01H 13/04* (2006.01)
*H01H 3/20* (2006.01)
(Continued)

(52) U.S. Cl.
CPC ..... *H01H 13/04* (2013.01); *H01H 3/20* (2013.01); *H01H 13/52* (2013.01); *H01H 13/56* (2013.01)

(58) Field of Classification Search
CPC ..... H01H 3/125; H01H 13/04; H01H 3/52; H01H 3/56; H01H 2221/044; H01H 13/70;
(Continued)

(56) References Cited

U.S. PATENT DOCUMENTS 5,475,192 A * 12/1995 Inagaki ..... H01H 13/705 200/341
8,089,011 B2 1/2012 Wang
(Continued)

FOREIGN PATENT DOCUMENTS

CN 102034630 A 4/2011
CN 105788923 A 7/2016
(Continued)

OTHER PUBLICATIONS

Extended European search report, dated Dec. 9, 2020, listed in correspondent European patent application No. 20 187 618.2.

*Primary Examiner* — Ahmed M Saeed
(74) *Attorney, Agent, or Firm* — McClure, Qualey & Rodack, LLP

(57) ABSTRACT

The present disclosure provides an electronic device, including a housing, a button, and a switch. An opening is formed through a wall surface of the housing. The housing has a stopping portion integrally disposed on the wall surface and adjacent to the opening, a notch being defined between a part of the stopping portion and the wall surface, the notch having a notch height. The button is configured to be mounted at the opening and includes a pressing portion and an extending portion. The pressing portion is movably accommodated in the opening. An end of the extending portion is connected to the pressing portion, and the other end is fixed to the wall surface. The extending portion movably passes through the notch. A thickness of the extending portion passing through the notch is smaller than the notch height. A switch is disposed at a position corresponding to the pressing portion in the housing.

8 Claims, 6 Drawing Sheets

(51) Int. Cl.
*H01H 13/52* (2006.01)
*H01H 13/56* (2006.01)

(58) Field of Classification Search
CPC ..... H01H 13/705; H01H 3/122; H01H 13/20; H01H 13/702; H01H 13/79; H01H 3/12; H01H 13/02; H01H 13/30; H01H 13/08; H01H 13/36; H01H 13/14; H01H 13/52; H01H 13/56; H01H 13/704; H01H 13/507; H01H 13/78; H01H 13/7065
See application file for complete search history.

(56) References Cited

U.S. PATENT DOCUMENTS

| | | | | |
|---|---|---|---|---|
| 8,212,167 | B2 * | 7/2012 | Chen | H01H 13/705 200/345 |
| 2008/0064321 | A1 * | 3/2008 | Huang | H05K 5/0017 454/369 |
| 2011/0036693 | A1 | 2/2011 | Chen et al. | |

FOREIGN PATENT DOCUMENTS

| | | | |
|---|---|---|---|
| CN | 206250095 | U | 6/2017 |
| CN | 107452534 | A | 12/2017 |
| CN | 209104033 | U | 7/2019 |
| GB | 2086097 | A | 5/1982 |

* cited by examiner

ELECTRONIC DEVICE

CROSS-REFERENCE TO RELATED APPLICATION

This application claims the priority benefit of Taiwan application serial no. 108143831, filed on Nov. 29, 2019. The entirety of the above-mentioned patent application is hereby incorporated by reference herein and made a part of this specification.

BACKGROUND

Technical Field

The present disclosure relates to an electronic device with a button, and in particular, to an electronic device with a button that prevents overpressing.

Related Art

In an electronic device with a button, a stopping structure is usually disposed on the housing to limit the pressing stroke of the button, to prevent the button from overpressing which may damage the electronic switch in the housing. In most cases, the stopping structure needs to be assembled to the housing of the electronic device through an assembly procedure, and the housing can prevent the button from overpressing only after assembled with the stopping structure.

However, the size and pressing stroke of the button on the electronic device are generally not large. Accordingly, the size of the stopping structure set corresponding to the size of the button is also not large. Therefore, it is difficult and time-consuming to assemble the stopping structure, and an allowable value of the assembly tolerance is not high, resulting in high assembly costs.

SUMMARY

The present disclosure provides an electronic device, including a housing, a button, and a switch. An opening is formed through a wall surface of the housing. The housing has a stopping portion integrally disposed on the wall surface and adjacent to the opening, a notch being defined between a part of the stopping portion and the wall surface, the notch having a notch height. The button is configured to be mounted at the opening and includes a pressing portion and an extending portion. The pressing portion is movably accommodated in the opening. An end of the extending portion is connected to the pressing portion, and the other end is fixed to the wall surface. The extending portion movably passes through the notch. A thickness of the extending portion passing through the notch is smaller than the notch height. A switch is disposed at a position corresponding to the pressing portion in the housing.

In an embodiment, the housing includes two stopping portions spaced apart along a contour of the opening, and the button has two extending portions disposed corresponding to the two stopping portions to pass through the notch.

In an embodiment, the two stopping portions and the two extending portions corresponding to the two stopping portions are all symmetrically disposed.

In an embodiment, two notches are respectively located at a position spaced apart by a 180 degree central angle on a contour of the opening.

In an embodiment, the extending portion has a through hole, and the wall surface has a convex column, the through hole of the button being sleeved and welded to the convex column.

In an embodiment, the pressing portion is a cylinder, and the extending portion is a suspended arm with an end connected to the pressing portion.

In an embodiment, at least one bending portion is disposed between two ends of the extending portion.

In an embodiment, the extending portion further has a reinforcing rib protruding from a surface of the extending part and extending to the wall surface.

DETAILED DESCRIPTION

Figure 1:
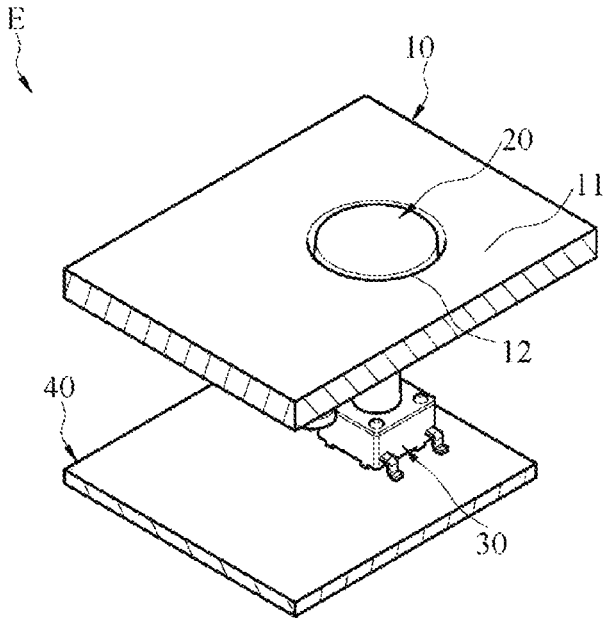
FIG. 1 is a schematic partial three-dimensional structural view according to an embodiment of an electronic device of the present disclosure.

FIG. 1 is a schematic partial three-dimensional structural view according to an embodiment of an electronic device of the present disclosure. According to FIG. 1, an electronic device E of FIG. 1 includes a housing 10, a button 20, and a switch 30. The button 20 is mounted at the housing 10 and is partially exposed for a user to press. The switch 30 is disposed at a position corresponding to the button 20 in the housing 10 to receive a trigger of the button 20.

Figure 2:
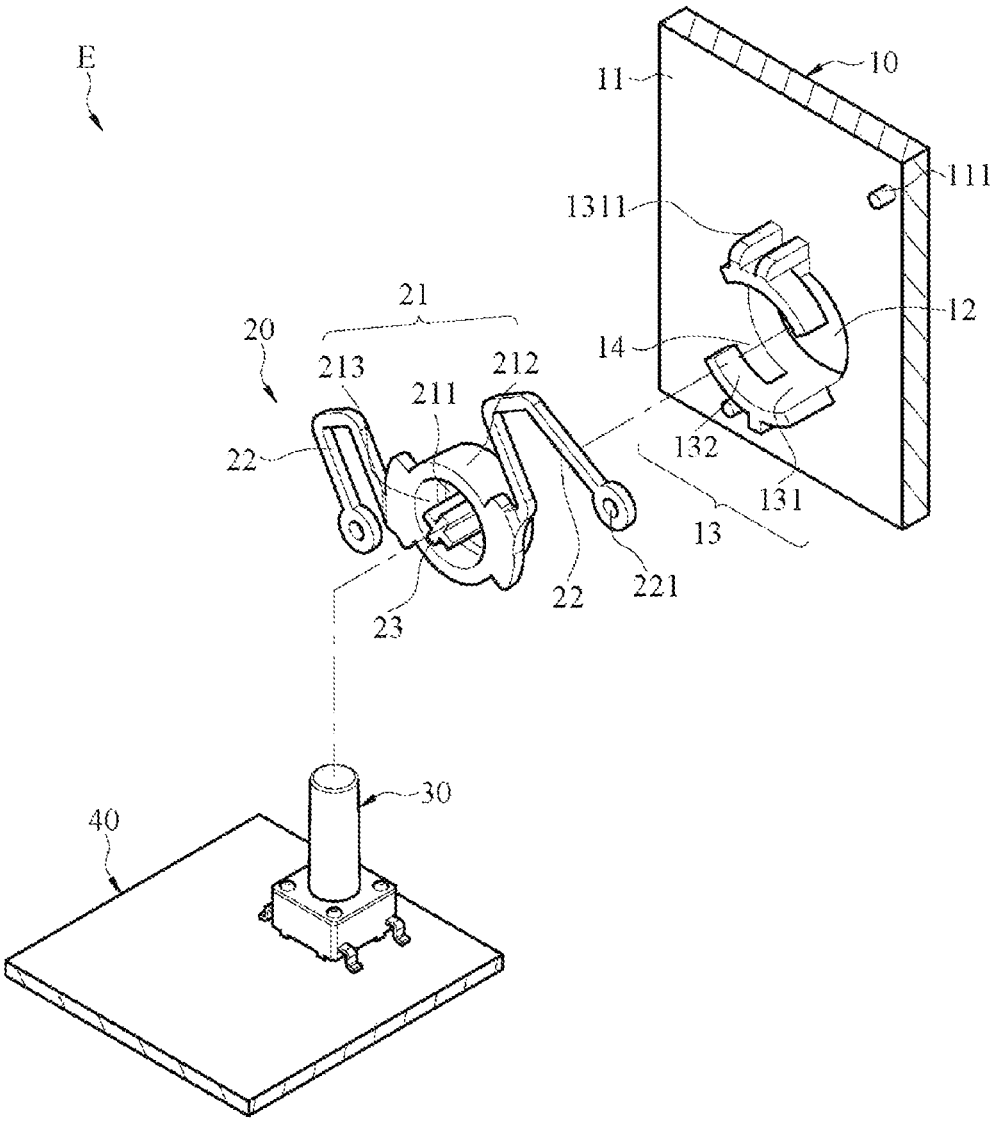
FIG. 2 is a schematic partial structural exploded view according to an embodiment of the electronic device of the present disclosure.

Referring to FIG. 1 and FIG. 2, FIG. 2 is a schematic partial structural exploded view according to an embodiment of the electronic device of the present disclosure. In this embodiment, an opening 12 is formed through a wall surface 11 of the housing 10, and the housing 10 has a stopping portion 13. The stopping portion 13 is integrally disposed on the wall surface 11 and adjacent to the opening 12, a notch 14 being defined between a part of the stopping portion 13 and the wall surface 11, the notch 14 having a notch height H. The button 20 is configured to be mounted at the opening 12 and has a pressing portion 21 and an extending portion 22. The pressing portion 21 is movably accommodated in the opening 12. An end of the extending portion 22 is connected to the pressing portion 21, and the other end is fixed to the wall surface 11. In addition, the extending portion 22 movably passes through the notch 14. A thickness D of the extending portion 22 passing through the notch 14 is smaller than the notch height H. The switch 30 is disposed at a position corresponding to the pressing portion 21 in the housing 10.

Accordingly, a distance by which the button 20 is displaced relative to the switch 30 in the opening 12 is clearly limited by a stopping portion 13 of the housing 10 to prevent the button 20 from being overpressed and damaging the switch 30 in the housing 10. Because the stopping portion 13 on the housing 10 is integrally formed on the housing 10, there is no need to assemble the stopping portion 13 through a separate procedure of assembly, reducing the procedure of and difficulty in assembly. In addition, a pressing stroke of the button 20 is directly defined by the thickness D and the notch height H of the extending portion 22, and is not affected by accuracy of assembly. In this way, the difficulty in assembly may also be reduced, and assembly efficiency and an economic benefit may be improved.

In an embodiment, the electronic device E may be, but not limited to, a server computer, a desktop computer, a notebook computer, a tablet computer, a media player, a video game instrument, a wireless telephone, a mobile communication device, home appliance, a power supply, a power supply switch, a function change switch, a router, a digital set-top box, various types of computer devices, various types of communication devices, and various types of switches. The button 20 may be, but not limited to, a power supply button, a switch button, or various function buttons. For clear description, a partial structure related to the button 20 after assembly is only shown in the housing 10 in the figure of the present disclosure.

In an embodiment, referring to FIG. 1 and FIG. 2, FIG. 2 is a schematic partial structural exploded view according to an embodiment of the electronic device of the present disclosure. In some embodiments, main appearance of the electronic device E may be constructed on the wall surface 11 of the housing 10, and the wall surface 11 of the housing 10 may surround and define an internal space of the housing 10 to assemble other operating parts of the electronic device E.

Referring to FIG. 2, an opening 12 is disposed on the wall surface 11 and penetrates through the wall surface 11 to communicate an inside with an outside of the housing 10 for the button 20 to be disposed. A contour of the opening 12 may be set corresponding to a shape of a part that is of the button 20 and that protrudes from the opening 12. In this embodiment, the contour of the opening 12 is circular, but the present disclosure is not limited thereto.

Figure 3:
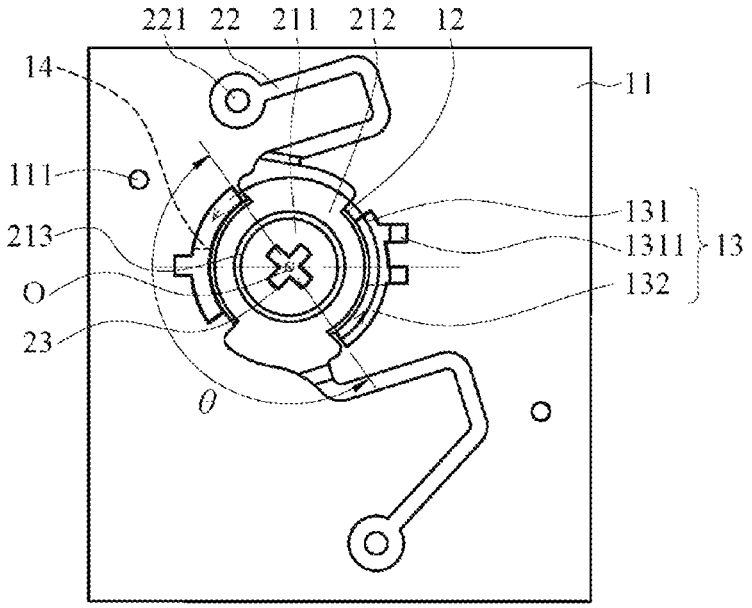
FIG. 3 is a schematic planar view according to an embodiment of a button during assembly of the electronic device of the present disclosure.
Figure 4:
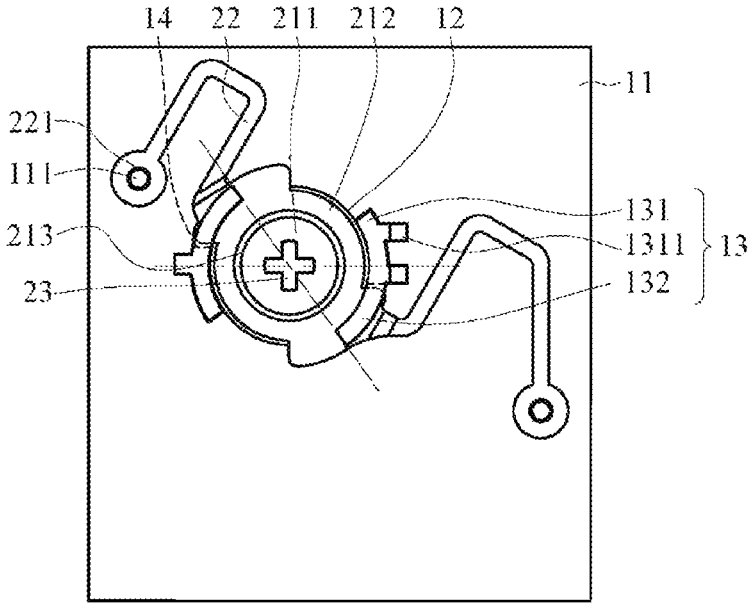
FIG. 4 is a schematic planar view according to an embodiment of a button after assembly of the electronic device of the present disclosure.
Figure 5:
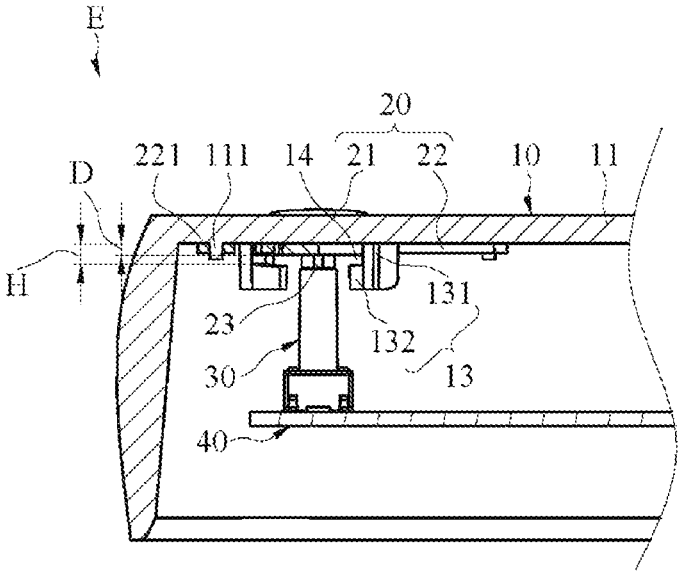
FIG. 5 is a partial structural assembled cross-sectional view according to an embodiment of the electronic device of the present disclosure.

Referring to FIG. 2 to FIG. 5, FIG. 3 is a schematic planar view according to an embodiment of a button 20 during assembly of the electronic device E of the present disclosure; FIG. 4 is a schematic planar view according to an embodiment of a button 20 after assembly of the electronic device E of the present disclosure; and FIG. 5 is a partial structural assembled cross-sectional view according to an embodiment of the electronic device E of the present disclosure. In an embodiment, a stopping portion 13 is integrally formed on the wall surface 11, and the stopping portion 13 is a structure protruding from the wall surface 11. To be specific, the stopping portion 13 includes a connecting section 131 and a suspending section 132. The connecting section 131 is connected to the wall surface 11 along the contour of the opening 12. The suspending section 132 is connected to the connecting section 131, and a notch 14 is defined between the suspending section and the wall surface 11. A notch height H between the suspending section 132 and the wall surface 11 is a distance between the suspending section 132 and the wall surface 11 in a direction perpendicular to the wall surface 11.

Referring to FIG. 2 to FIG. 4, in an embodiment, the housing 10 has two stopping portions 13 disposed symmetrically. The two stopping portions 13 are spaced apart along the contour of the opening 12. In this embodiment, a notch 14 is respectively formed between the two stopping portions 13 and the wall surface 11. The two notches 14 have a spaced included angle θ on the contour of the opening 12. The spaced included angle θ is a central angle formed between the two notches 14 relative to a center of a circle O of the opening 12. The spaced included angle θ between the two notches 14 on the contour of the opening 12 is 180 degrees.

Referring to FIG. 2 to FIG. 5, in this embodiment, an outer contour of the pressing portion 21 of the button 20 is a hollow cylinder corresponding to a shape of the opening 12. The pressing portion 21 has a cylindrical shape and is movably accommodated in the opening 12. In an embodiment, the pressing portion 21 has a top surface 211 and a peripheral surface 212. An outer contour of the top surface 211 is circular. The peripheral surface 212 is connected to the top surface 211 at an angle relative to the top surface 211. The peripheral surface 212 is disposed along an outer contour of the top surface 211. An inner hole 213 is constructed between the top surface 211 and the peripheral surface 212.

Referring to FIG. 2 to FIG. 5, in this embodiment, the button 20 has two extending portions 22. Each extending portion 22 is symmetrically connected to an end of the peripheral surface 212 of the pressing portion 21 away from the top surface 211. To be specific, the two extending portions 22 of the button 20 are strip-shaped. One end of each extending portion 22 is connected to the pressing portion 21, and the other end extends away from the pressing portion 21 to become a suspended arm. There is at least one bending portion between two ends of the extending portion 22. The bending portion may be, but not limited to, ⊓-shaped or U-shaped, so that the two ends of the extending portion 22 have elastic deformation capability. In addition, the two extending portions 22 of the button 20 are disposed corresponding to positions of the stopping portions 13 to pass through the notches 14 formed between the two stopping portions 13 and the wall surface 11.

Referring to FIG. 2 and FIG. 5, the switch 30 may be electrically connected to a circuit board 40 fixed in the housing 10. The switch 30 is an inner hole 213 facing the pressing portion 21. In an embodiment, the button 20 further includes a trigger convex portion 23. The trigger convex portion 23 is disposed in the inner hole 213 of the pressing portion 21. The trigger convex portion 23 extends toward the switch 30 for a length to apply a pressure to trigger the switch 30. The trigger convex portion 23 may be, but not limited to, a cylinder with a cross-shaped cross section.

Referring to FIG. 2 to FIG. 5, during assembly of the button 20, the position of the pressing portion 21 of the button 20 corresponds to the position of the opening 12, and the position of the extending portion 22 is first kept away from the position of the stopping portion 13 on the housing 10. Next, the pressing portion 21 is accommodated in the opening 12, and the extending portion 22 abuts against the wall surface 11 of the housing 10. Then, the button 20 is rotated to displace the extending portion 22 of the button 20 into the notch 14, so that an end of the extending portion 22 of the button 20 away from the pressing portion 21 is fixed to the wall surface 11. Because a notch height H is greater than a thickness D of the extending portion 22 of the button 20, after the extending portion 22 is assembled into the notch 14, the extending portion 22 of the button 20 does not fill the notch 14 fully. In this way, there is an interval between the extending portion 22 and the wall surface 11 or the suspending section 132 in the notch 14. The interval between the extending portion 22 and the wall surface 11 or the suspending section 132 is a difference between the notch height H and the thickness D of the extending portion 22, and the interval between the extending portion 22 and the wall surface 11 or the suspending section 132 is a distance by which the button 20 is allowed to be displaced in the opening 12.

Based on the foregoing, there is no need to assemble the stopping portion 13 through an additional procedure for the housing 10 of the electronic device E. During assembly of the button 20, the button 20 can be positioned on the housing 10 through the cooperation of the structure of the button 20 and the stopping portion 13. The procedure of assembling the button 20 is simple. Because the distance by which the button 20 after assembly is displaced is determined, the switch 30 can be prevented from being damaged due to overpressing.

In an embodiment, a connecting section 131 of the stopping portion 13 further has a reinforcing rib 1311. The reinforcing rib 1311 protrudes from a surface of the connecting section 131 and extends to the wall surface 11. The reinforcing rib 1311 helps to increase the structural strength of the stopping portion 13. Therefore, the structural stability is ensured when the button 20 is pressed to apply a force to the stopping portion 13.

In an embodiment, in order to further improve stability of the button 20 assembled on the housing 10, a convex column 111 may be further disposed on the wall surface 11 of the housing, and a through hole 221 is disposed at an end of each extending portion 22 of the button 20 away from the pressing portion 21. When the button 20 is assembled in the housing 10, the through hole 221 of each extending portion 22 of the button 20 may be correspondingly sleeved on the convex column 111 to improve the stability of the button 20 after assembly.

In addition, in an embodiment, in order to further strengthen configuration of the button 20, each extending portion 22 of the button 20 may be fixed to the wall surface 11 of the housing 10 in a fixing manner after the button 20 is limited by the stopping portion 13 of the housing 10. The fixing manner may not be limited to a manner for fixing the extending portion 22 to the wall surface 11 such as gluing or locking.

In the embodiment in which the button 20 is sleeved on the convex column 111 of the housing 10 through the through hole 221, the button 20 may be welded to the convex column 111 while being sleeved on the convex column 111 through the through hole 221, thereby better ensuring stability of connection between the button 20 and the housing 10.

Figure 6:
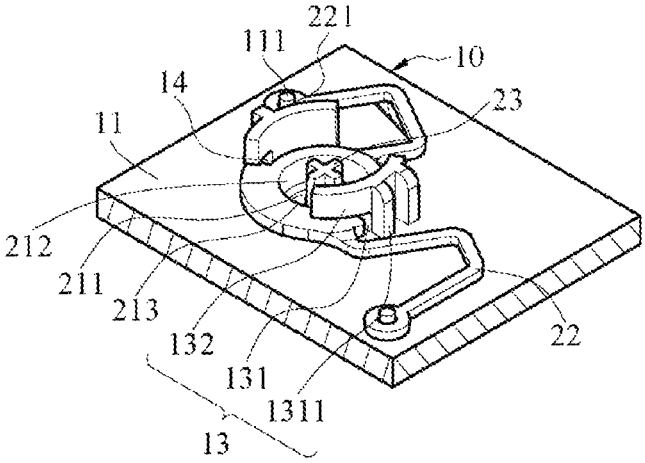
FIG. 6 is a schematic partial structural three-dimensional assembled view according to another embodiment of the electronic device of the present disclosure.
Figure 7:
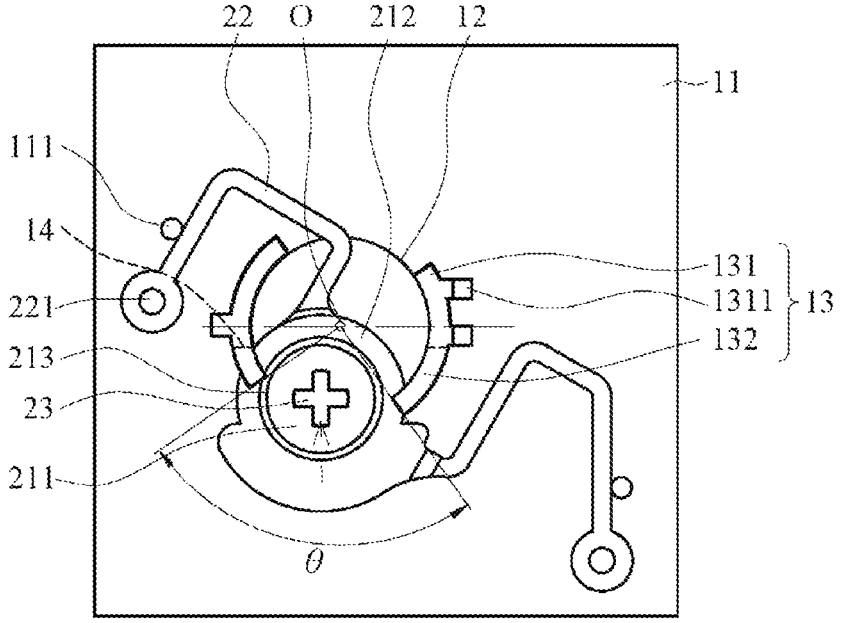
FIG. 7 is a planar view of a button during assembly according to another embodiment of the electronic device of the present disclosure.
Figure 8:
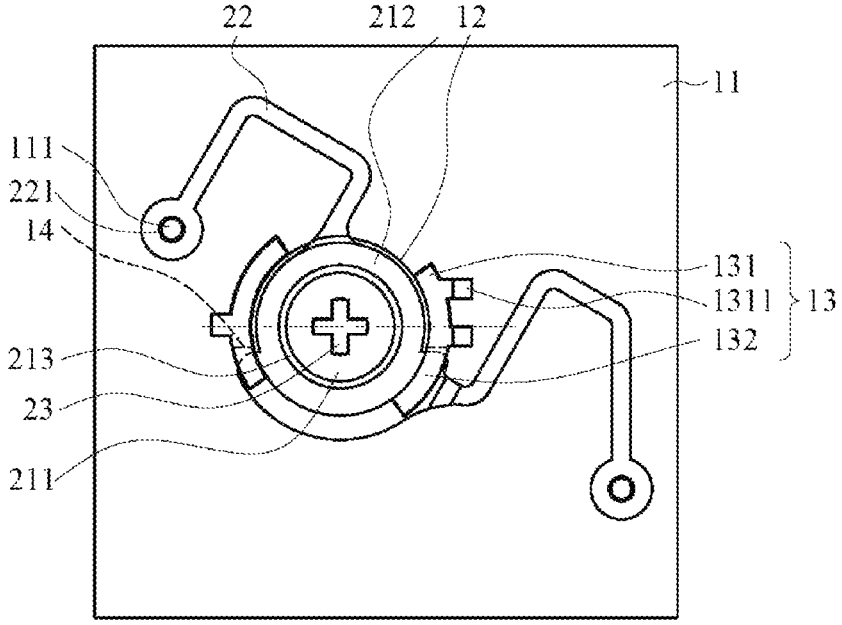
FIG. 8 is a planar view of a button after assembly according to another embodiment of the electronic device of the present disclosure.

Referring to FIG. 6 to FIG. 8, FIG. 6 is a schematic partial structural three-dimensional assembled view according to another embodiment of the electronic device E of the present disclosure; FIG. 7 is a planar view of a button 20 during assembly according to another embodiment of the electronic device E of the present disclosure; and FIG. 8 is a planar view of a button 20 after assembly according to another embodiment of the electronic device E of the present disclosure. The position of the notch 14 on the housing 10 formed by the stopping portion 13 is not limited to the foregoing embodiment. In an embodiment, a spaced included angle θ between the two notches 14 on the housing 10 formed by the stopping portion 13 on the contour of the opening 12 may also be less than 180 degrees. In this way, during assembly of the button 20, the button 20 may assemble the extending portion 22 into the notch 14 in a translational manner, thereby providing another structural configuration with a different assembly method.

Although the present disclosure is described with reference to some embodiments, the embodiments are not intended to limit the present disclosure. A person of ordinary skill in the art may make variations and modifications without departing from the spirit and scope of the present disclosure. Therefore, the protection scope of the present disclosure should be subject to the appended claims of this specification.

What is claimed is:

1. An electronic device, comprising:

a housing, an opening being formed through a wall surface of the housing, wherein the housing has a stopping portion integrally disposed on the wall surface and adjacent to the opening, a notch being defined between a part of the stopping portion and the wall surface, the notch having a notch height in a pressing direction perpendicular to the wall surface;

a button configured to be mounted at the opening and comprising:

a pressing portion movably accommodated in the opening along the pressing direction; and an extending portion, an end of the extending portion being connected to the pressing portion, and the other end being fixed to the wall surface, wherein the extending portion passes through the notch and is movable along the pressing direction between the stopping portion and the wall surface, a thickness of the extending portion passing through the notch being less than the notch height, and an interval is formed between the extending portion and the stopping portion; and a switch disposed at a position corresponding to the pressing portion in the housing.

2. The electronic device according to claim 1, wherein the housing comprises two stopping portions spaced apart along a contour of the opening, and the button has two extending portions disposed corresponding to the two stopping portions to pass through the notch.

3. The electronic device according to claim 2, wherein the two stopping portions and the two extending portions corresponding to the two stopping portions are all symmetrically disposed.

4. The electronic device according to claim 2, wherein two notches are respectively located at a position spaced apart by a 180 degree central angle on the contour of the opening.

5. The electronic device according to claim 1, wherein the extending portion has a through hole, and the wall surface has a convex column, the through hole of the button being sleeved and welded to the convex column.

6. The electronic device according to claim 1, wherein the pressing portion is a cylinder, and the extending portion is a suspended arm with an end connected to the pressing portion.

7. The electronic device according to claim 1, wherein at least one bending portion is disposed between two ends of the extending portion.

8. The electronic device according to claim 1, wherein a reinforcing rib further protrudes from the stopping portion, the reinforcing rib extending to the wall surface.

* * * * *